US010450860B2

(12) United States Patent
Polyakov et al.

(10) Patent No.: US 10,450,860 B2
(45) Date of Patent: Oct. 22, 2019

(54) INTEGRATING RESERVOIR MODELING WITH MODELING A PERTURBATION

(71) Applicants: Valery Polyakov, Brookline, MA (US); Dzevat Omeragic, Lexington, MA (US); Torbjørn Vik, Olso (NO); Tarek M. Habashy, Burlington, MA (US)

(72) Inventors: Valery Polyakov, Brookline, MA (US); Dzevat Omeragic, Lexington, MA (US); Torbjørn Vik, Olso (NO); Tarek M. Habashy, Burlington, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 542 days.

(21) Appl. No.: 13/666,815

(22) Filed: Nov. 1, 2012

(65) Prior Publication Data

US 2013/0110486 A1 May 2, 2013

Related U.S. Application Data

(60) Provisional application No. 61/554,197, filed on Nov. 1, 2011.

(51) Int. Cl.
*E21B 49/00* (2006.01)

(52) U.S. Cl.
CPC ..... *E21B 49/00* (2013.01)

(58) Field of Classification Search
None
See application file for complete search history.

(56) References Cited

U.S. PATENT DOCUMENTS

| | | | | |
|---|---|---|---|---|
| 5,992,519 | A | 11/1999 | Ramakrishnan et al. | |
| 6,313,837 | B1 | 11/2001 | Assa et al. | |
| 7,248,259 | B2 | 7/2007 | Fremming | |
| 8,489,375 | B2 | 7/2013 | Omeragic et al. | |
| 2003/0216897 | A1 | 11/2003 | Endres et al. | |
| 2004/0204855 | A1* | 10/2004 | Fleury et al. | 702/6 |
| 2005/0149307 | A1 | 7/2005 | Gurpinar et al. | |
| 2005/0235745 | A1* | 10/2005 | Proett et al. | 73/152.22 |
| 2006/0197759 | A1 | 9/2006 | Fremming | |
| 2011/0184711 | A1* | 7/2011 | Altman et al. | 703/10 |
| 2011/0264430 | A1* | 10/2011 | Tapscott et al. | 703/10 |

FOREIGN PATENT DOCUMENTS

| | | |
|---|---|---|
| WO | 9964896 | 12/1999 |
| WO | 2004049216 | 6/2004 |

OTHER PUBLICATIONS

Polyakov, V., et al. "Interactive log simulation and inversion on the web." SPE Annual Technical Conference and Exhibition. Society of Petroleum Engineers, 2004.*

(Continued)

*Primary Examiner* — Bijan Mapar

(57) ABSTRACT

A method for characterizing a subterranean formation traversed by a wellbore includes generating a reservoir model using data collected from the formation, generating a perturbation object comprising a perturbation of the wellbore, integrating the perturbation object with the reservoir model, and forming a geological model wherein the perturbation object is integrated in the reservoir model.

36 Claims, 11 Drawing Sheets

(56) References Cited

OTHER PUBLICATIONS

Shyamal Mitra. "DAGH: Users Guide, Adaptive Mesh Refinement." University of Texas at Austin, Jul. 7, 2001. Retreived from http://www.cs.utexas.edu/users/dagh/ch2.html.*

Alpak, F. O., and C. Torres-Verdin. "Data-Adaptive Resolution Method for the Parametric Three-Dimensional Inversion of Triaxial Borehole Electromagnetic Measurements." Progress in Electromagnetics Research B, vol. 25, 93-111, 2010. (Year: 2010).*

Alpak et al., "Numerical Simulation of Mud-Filtrate Invasion in Horizontal wells and Sensitivity Analysis of Array Induction Tools," Petrophysics, Nov.-Dec. 2003, vol. 11: pp. 396-411.

Alpak et al., "Joint Inversion of Transient-Pressure and Time-lapse Electromagnetic Logging Measurements," Petrophysics, May-Jun. 2004, vol. 6: pp. 251-267.

Maeso, "Invasion in the Time Domain from LWD Resistivity: An Untapped Wealth of Information," SPWLA 51st Annual Logging Symposium, Jun. 2010: pp. 1-11.

Omeragic et al., "3D Reservoir Characterization and Well Placement in Complex Scenarios Using LWD Directional EM Measurements," Petrophysics, Oct. 2009, vol. 50(5): pp. 396-415.

Pereira et al., "IPB2312_08: Estimation of Permeability and Permeability Anisotropy in Horizontal Wells Through Numerical Simulation of Mud Filtrate Invasion," Brazilian Petroleum, Gas and Biofuels Institute, Rio Oil & Gas Expo and Conference, 2008: pp. 1-10.

Ramakrishnan et al., "Formation producibility and fractional flow curves from radial resistivity variation caused by drilling fluid invasion," Phys. Fluids., Apr. 1997, vol. 9(4): pp. 833-844.

Semmelbeck et al., "SPE 30581: Invasion-Based Method for Estimating Permeability From Logs," SPE International, 1995: pp. 517-531.

Yao et al., "Reservoir Permeability Estimation From Time-Lapse Log Data," SPE Formation Evaluation, Jun. 1996: pp. 69-74.

* cited by examiner

FIG.10
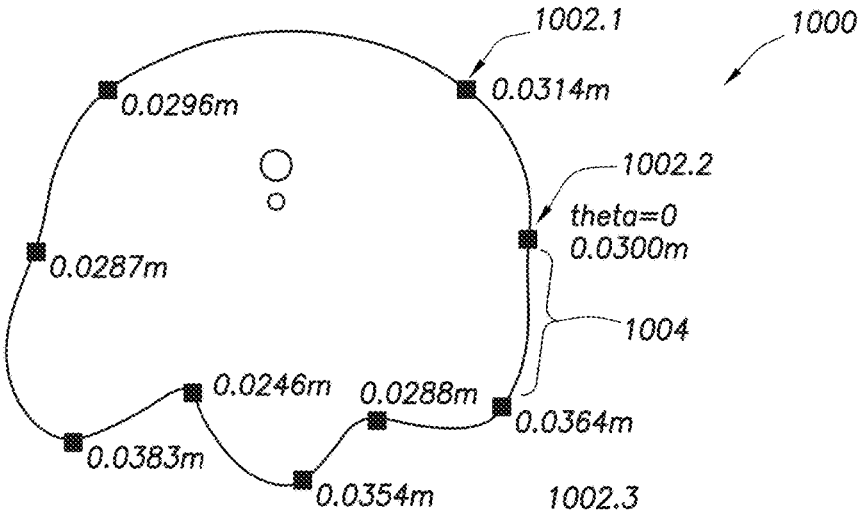
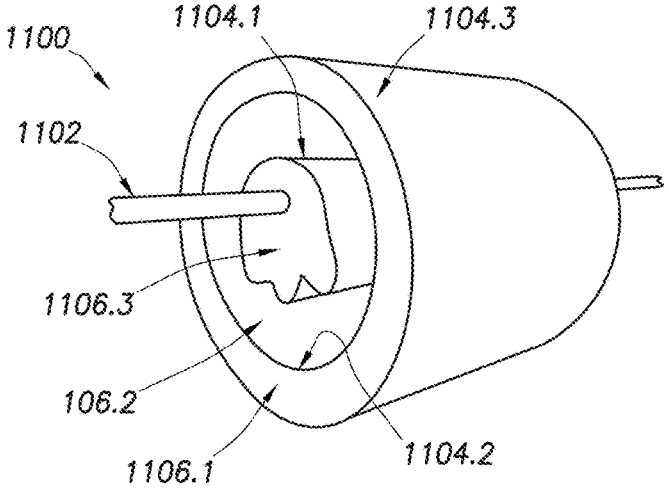
FIG.11
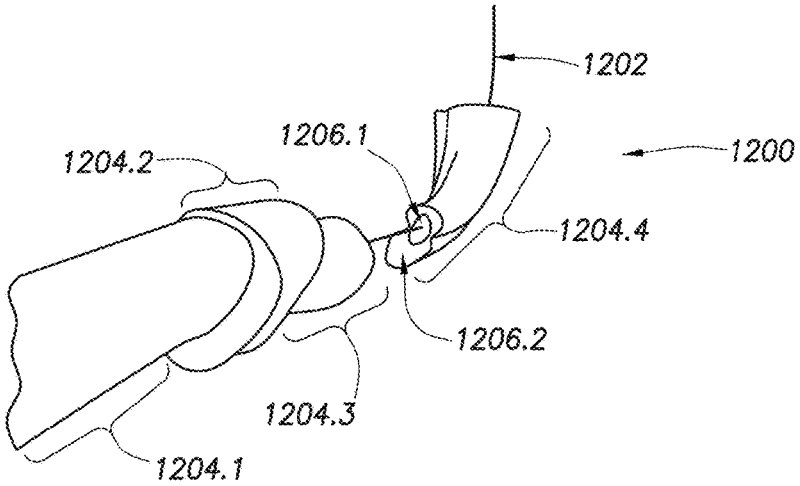
FIG.12

INTEGRATING RESERVOIR MODELING WITH MODELING A PERTURBATION

CROSS-REFERENCE TO RELATED APPLICATION

This application claims priority, pursuant to 35 U.S.C. § 119(e), to the filing date of U.S. Patent Application Ser. No. 61/554,197, entitled "SYSTEM AND METHOD FOR MODELING DRILLING MUD INVASION INTEGRATED WITH GEOLOGICAL MODELS AND WELL LOG MODELING AND INVERSION" filed on Nov. 1, 2011, which is hereby incorporated by reference in its entirety.

BACKGROUND

Operations, such as surveying, drilling, wireline testing, completions, production, planning and field analysis, are typically performed to locate and gather valuable downhole fluids. Surveys are performed using acquisition methodologies, such as seismic scanners or surveyors to obtain data about underground formations. During drilling and production operations, data is typically collected for analysis and/or monitoring of the operations. Such data may include, for instance, information regarding subterranean formations, information detailing how the drilling and/or production equipment are operating, information regarding the amount of fluid that is obtained or used, and/or other data. Typically, simulators use the gathered data to model specific behavior of discrete portions of the operations.

SUMMARY

In general, in one aspect, embodiments related to a method for characterizing a subterranean formation traversed by a wellbore. The method includes generating a reservoir model using data collected from the formation, generating a perturbation object comprising a perturbation of the wellbore, integrating the perturbation object with the reservoir model, and forming a geological model wherein the perturbation object is integrated in the reservoir model.

In general, in one aspect, embodiments related to a system for characterizing a subterranean formation traversed by a wellbore. The system includes a computer processor, a data repository for storing a perturbation object representing a perturbation, and a perturbation object modeling module, executing on the computer processor. The perturbation object modeling module is configured to generate the perturbation object, and integrate the perturbation object with a reservoir model. The system further includes a reservoir modeling package, executing on the computer processor. The reservoir modeling package includes a well log modeling module configured to generate the reservoir model using data collected from the formation, and an interface configured to display a geological model wherein the perturbation object is integrated in the reservoir model.

In general, in one aspect, embodiments relate to a non-transitory computer readable medium that includes computer readable program code embodied therein for generating a reservoir model using data collected from a subterranean formation, generating a perturbation object representing a perturbation along a well trajectory at a hydrocarbon reservoir, integrating the perturbation object with the reservoir model, and forming a geological model wherein the perturbation object is integrated in the reservoir model.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

Embodiments of integrating invasion modeling with reservoir modeling are described with reference to the following figures. The same numbers are used throughout the figures to reference like features and components.

FIG. 8-15 show examples of one or more embodiments.

DETAILED DESCRIPTION

Figure 1:
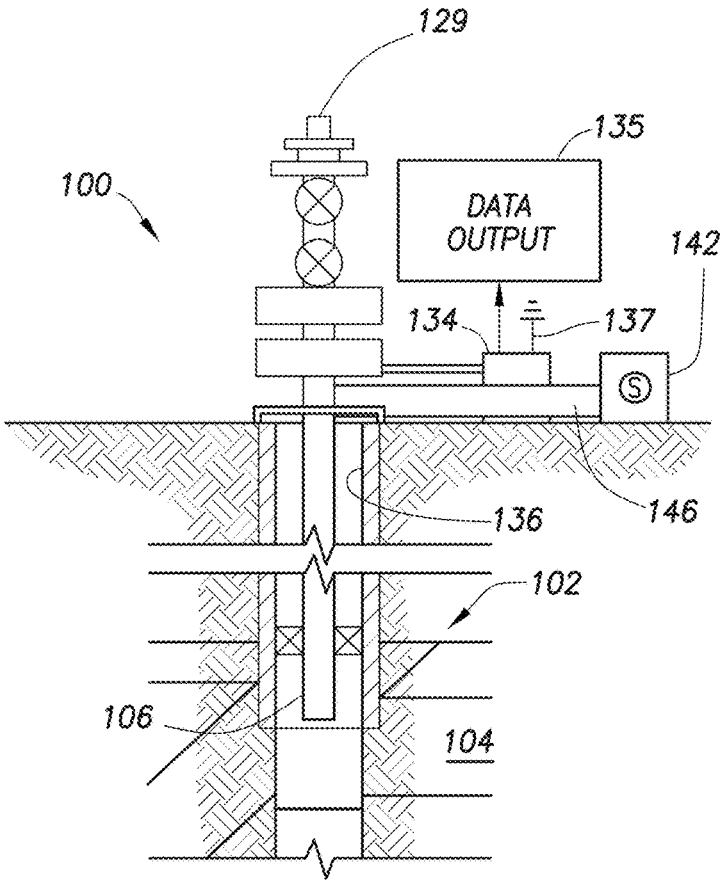
FIGS. 1-6 show example schematic diagrams of one or more embodiments.

Specific embodiments will now be described in detail with reference to the accompanying figures. Like elements in the various figures are denoted by like reference numerals for consistency.

In the following detailed description of embodiments, numerous specific details are set forth in order to provide a more thorough understanding. However, it will be apparent to one of ordinary skill in the art that the invention may be practiced without these specific details. In other instances, well-known features have not been described in detail to avoid unnecessarily complicating the description.

In general, embodiments are directed to characterizing a subterranean formation traversed by a wellbore. As a practical matter, throughout this specification, the terms wellbore and borehole are used interchangeably to indicate a void in a subterranean formation often created by a drill or other earth moving device. The void may be cased or uncased. The cross sectional area may be cylindrical, elliptical, random, or a combination thereof.

Specifically, embodiments integrate reservoir modeling with modeling of a perturbation along the wellbore trajectory at a hydrocarbon reservoir. A perturbation object representing the perturbation is generated and integrated with a reservoir model. Integrating the perturbation object and the reservoir model includes accounting for the affects of, knowledge gained from the perturbation on the reservoir by adjusting the reservoir model based on the perturbation object, and accounting for the affects of, and knowledge gained from the reservoir on the perturbation by adjusting the perturbation object based on the reservoir model. A geological model that has the perturbation object integrated with the reservoir model is formed.

In general, a perturbation is a variation of the formation resulting from introducing a borehole into the formation. A single or multiple perturbations may exist along the same wellbore trajectory. Further, a perturbation is not necessarily rare or seldom occurring. Rather, a perturbation may occur with some frequency. For example, a perturbation may be an invasion, such as an invasion of mud filtrate, in a wellbore. As another example, a perturbation may be borehole shape change. Such shape change may be a breakout or a widening or narrowing or the borehole in one or more embodiments. In the second example, a borehole shape change may be a deviation from the borehole being in a cylindrical form.

In the case of invasion, embodiments provide a method and apparatus for analyzing data when an invasion exists. In one or more embodiments, an invasion is the movement of fluid, such as mud filtrate and/or other fluid, into a formation around a borehole. The invasion of the fluid may affect the accuracy of determining in-situ formation properties. One or more embodiments include functionality to generate an invasion model and integrate the invasion model with a reservoir model. Thus, both the invasion model integrated with the reservoir model may be displayed for the user and/or used to more accurately determine formation properties and/or geometry that account for the invasion. Further, one or more embodiments include functionality to modify drilling and/or production operations based on the revised determination of the formation properties.

FIG. 1 depicts a simplified, representative, schematic view of a field (100) having subterranean formation (102) having reservoir (104) therein and depicting a production operation being performed on the field (100). More specifically, FIG. 1 depicts a production operation being performed by a production tool (106) deployed from a production unit or christmas tree (129) and into a completed wellbore (136) for drawing fluid from the downhole reservoirs into the surface facilities (142). Fluid flows from reservoir (104) through perforations in the casing (not shown) and into the production tool (106) in the wellbore (136) and to the surface facilities (142) via a gathering network (146).

Sensors (S), such as gauges, may be positioned about the field to collect data relating to various field operations as described previously The data gathered by the sensors (S) may be collected by the surface unit (134) and/or other data collection sources for analysis or other processing. The data collected by the sensors (S) may be used alone or in combination with other data. Further, the data outputs from the various sensors (S) positioned about the field may be processed for use. The data may be collected in one or more databases and/or all or transmitted on or offsite. All or select portions of the data may be selectively used for analyzing and/or predicting operations of the current and/or other wellbores. The data may be may be historical data, real time data or combinations thereof. The real time data may be used in real time, or stored for later use. The data may also be combined with historical data or other inputs for further analysis. The data may be stored in separate data repositories, or combined into a single data repository.

The collected data may be used to perform analysis, such as modeling operations. For instance, seismic data output may be used to perform geological, geophysical, and/or reservoir engineering. The reservoir, wellbore, surface and/or process data may be used to perform reservoir, wellbore, geological, geophysical or other simulations. The data outputs from the operation may be generated directly from the sensors (S), or after some preprocessing or modeling. These data outputs may act as inputs for further analysis.

The data is collected and stored at the surface unit (134). One or more surface units (134) may be located at the field (100), or connected remotely thereto. The surface unit (134) may be a single unit, or a complex network of units used to perform the necessary data management functions throughout the field (100). The surface unit (134) may be a manual or automatic system. The surface unit (134) may be operated and/or adjusted by a user.

The surface unit (134) may be provided with a transceiver (137) to allow communications between the surface unit (134) and various portions of the field (100) or other locations. The surface unit (134) may also be provided with or functionally connected to one or more controllers for actuating mechanisms at the field (100). The surface unit (134) may then send command signals to the field (100) in response to data received. The surface unit (134) may receive commands via the transceiver or may itself execute commands to the controller. A processor may be provided to analyze the data (locally or remotely) and make the decisions and/or actuate the controller. In this manner, the field (100) may be selectively adjusted based on the data collected. This technique may be used to optimize portions of the operation, such as controlling wellhead pressure, choke size or other operating parameters. These adjustments may be made automatically based on computer protocol, and/or manually by an operator. In some cases, well plans may be adjusted to select optimum operating conditions, or to avoid problems.

As shown, the sensor (S) may be positioned in the production tool (106) or associated equipment, such as the christmas tree, gathering network, surface facilities and/or the production facility, to measure fluid parameters, such as fluid composition, flow rates, pressures, temperatures, and/or other parameters of the production operation.

While FIG. 1 depicts tools used to measure properties of a field (100), it will be appreciated that the tools may be used in connection with non-wellsite operations, such as mines, aquifers, storage or other subterranean facilities. Also, while certain data acquisition tools are depicted, it will be appreciated that various measurement tools capable of sensing parameters, such as seismic two-way travel time, density, resistivity, production rate, etc., of the subterranean formation and/or its geological formations may be used. Various sensors (S) may be located at various positions along the wellbore and/or the monitoring tools to collect and/or monitor the desired data. Other sources of data may also be provided from offsite locations.

The field configuration in FIG. 1 is intended to provide a brief description of a field usable for improving production by actual loss allocation. Part, or all, of the field (100) may be on land, sea and/or water. Production may also include injection wells (not shown) for added recovery. One or more gathering facilities may be operatively connected to one or more of the wellsites for selectively collecting downhole fluids from the wellsite(s). Also, while a single field measured at a single location is depicted, improving production by actual loss allocation may be utilized with any combination of one or more fields (100), one or more processing facilities and one or more wellsites.

Figure 2:
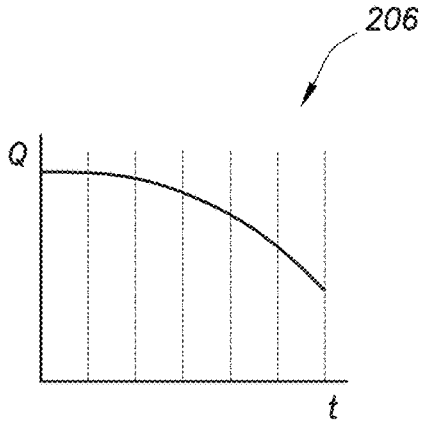

FIG. 2 is a graphical depiction of data collected by the tools of FIG. 1. FIG. 2 depicts a production decline curve or graph (206) of fluid flowing through the subterranean formation of FIG. 1 measured at the surface facilities (142). The production decline curve (206) typically provides the production rate (Q) as a function of time (t).

The respective graphs of FIG. 2 depict static measurements that may describe information about the physical characteristics of the formation and reservoirs contained therein. These measurements may be analyzed to better define the properties of the formation(s) and/or determine the accuracy of the measurements and/or for checking for errors. The plots of each of the respective measurements may be aligned and scaled for comparison and verification of the properties.

FIG. 2 depicts a dynamic measurement of the fluid properties through the wellbore. As the fluid flows through the wellbore, measurements are taken of fluid properties, such as flow rates, pressures, composition, etc. As described below, the static and dynamic measurements may be analyzed and used to generate models of the subterranean formation to determine characteristics thereof. Similar measurements may also be used to measure changes in formation aspects over time.

Figure 3:
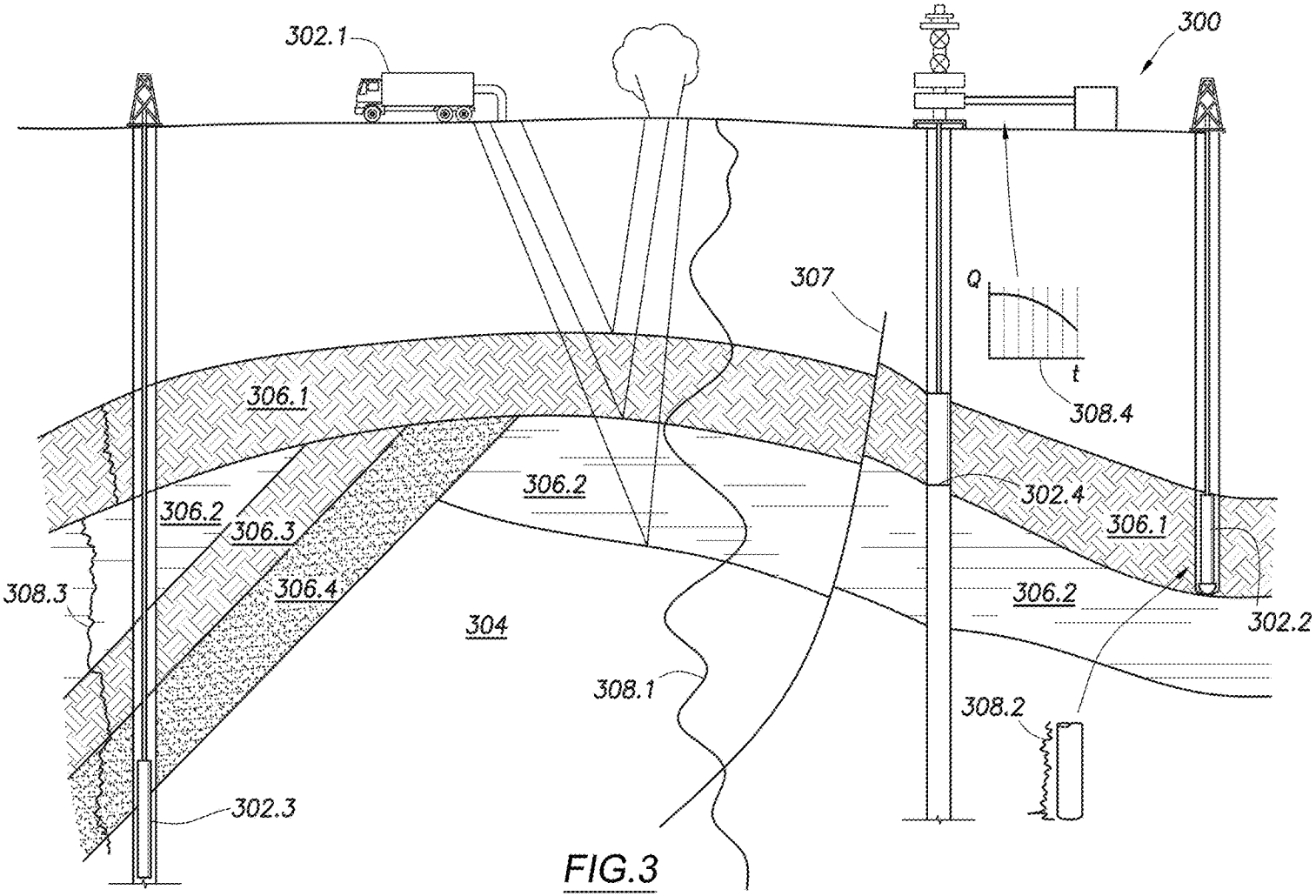

FIG. 3 is a schematic view, partially in cross section of a field (300) having data acquisition tools (302.1, 302.2, 302.3, and 302.4) positioned at various locations along the field for collecting data of a subterranean formation 304. The data acquisition tool (302.4) may be the same as data acquisition tool (106.4) of FIG. 1, respectively, or others not depicted. As shown, the data acquisition tools (302.1-302.4) generate data plots or measurements (308.1-308.4), respectively. These data plots are depicted along the field to demonstrate the data generated by various operations.

Data plots (308.1-308.3) are static data plots that may be generated by the data acquisition tools (302.1-302.4), respectively. Static data plot (308.1) is a seismic two-way response time. Static plot (308.2) is core sample data measured from a core sample of the formation (304). Static data plot (308.3) is a logging trace. Production decline curve or graph (308.4) is a dynamic data plot of the fluid flow rate over time, similar to the graph (206) of FIG. 2. Other data may also be collected, such as historical data, user inputs, economic information, and/or other measurement data and other parameters of interest.

The subterranean formation (304) has a plurality of geological formations (306.1-306.4). As shown, the structure has several formations or layers, including a shale layer (306.1), a carbonate layer (306.2), a shale layer (306.3) and a sand layer (306.4). A fault line (307) extends through the layers (306.1-306.2). The static data acquisition tools are adapted to take measurements and detect the characteristics of the formations.

While a specific subterranean formation (304) with specific geological structures is depicted, it will be appreciated that the field may contain a variety of geological structures and/or formations, sometimes having extreme complexity. In some locations, typically below the water line, fluid may occupy pore spaces of the formations. Each of the measurement devices may be used to measure properties of the formations and/or its geological features. While each acquisition tool is shown as being in specific locations in the field, it will be appreciated that one or more types of measurement may be taken at one or more location across one or more fields or other locations for comparison and/or analysis.

The data collected from various sources, such as the data acquisition tools of FIG. 3, may then be processed and/or evaluated. Typically, seismic data displayed in the static data plot (308.1) from the data acquisition tool (302.1) is used by a geophysicist to determine characteristics of the subterranean formations (304) and features. Core data shown in static plot (308.2) and/or log data from the well log (308.3) is typically used by a geologist to determine various characteristics of the subterranean formation (304). Production data from the graph (308.4) is typically used by the reservoir engineer to determine fluid flow reservoir characteristics. The data analyzed by the geologist, geophysicist and the reservoir engineer may be analyzed using modeling techniques. Modeling techniques are described in Application/Publication/Patent No. U.S. Pat. No. 5,992,519, WO2004/049216, WO1999/064896, U.S. Pat. No. 6,313,837, US2003/0216897, U.S. Pat. No. 7,248,259, US2005/0149307 and US2006/0197759. Systems for performing such modeling techniques are described, for instance, in U.S. Pat. No. 7,248,259, the entire contents of which are hereby incorporated by reference.

Data may be collected by various sensors, for example, during drilling operations. Specifically, drilling tools suspended by a rig may advance into the subterranean formations to form a wellbore (i.e., a borehole). The borehole may have a trajectory in the subterranean formations that is vertical, horizontal, or a combination thereof. Specifically, the trajectory defines the path of the drilling tools in the subterranean formation. A mud pit (not shown) is used to draw drilling mud into the drilling tools via flow line for circulating drilling mud through the drilling tools, up the wellbore and back to the surface. The drilling mud is usually filtered and returned to the mud pit. Occasionally, such mud invades the formation surrounding the borehole resulting in an invasion. Continuing with the discussion of drilling operations, a circulating system may be used for storing, controlling, or filtering the flowing drilling mud. The drilling tools are advanced into the subterranean formations to reach reservoir. Each well may target one or more reservoirs.

The drilling tools are preferably adapted for measuring downhole properties using logging while drilling tools. Specifically, the logging while drilling tools include sensors for gathering well logs while the borehole is being drilled. In one or more embodiments, during the drilling operations, the sensors may pass through the same depth multiple times. The data collected by the sensors may be similar or the same as the data collected by the sensors discussed below with reference to FIG. 5. During each pass of the drilling tools, the logging while drilling tools include functionality to gather oilfield data associated with a time of the pass and store such data into the well logs. In one or more embodiments, the logging while drilling tool may also be adapted for taking a core sample or removed so that a core sample may be taken using another tool.

Figure 4:
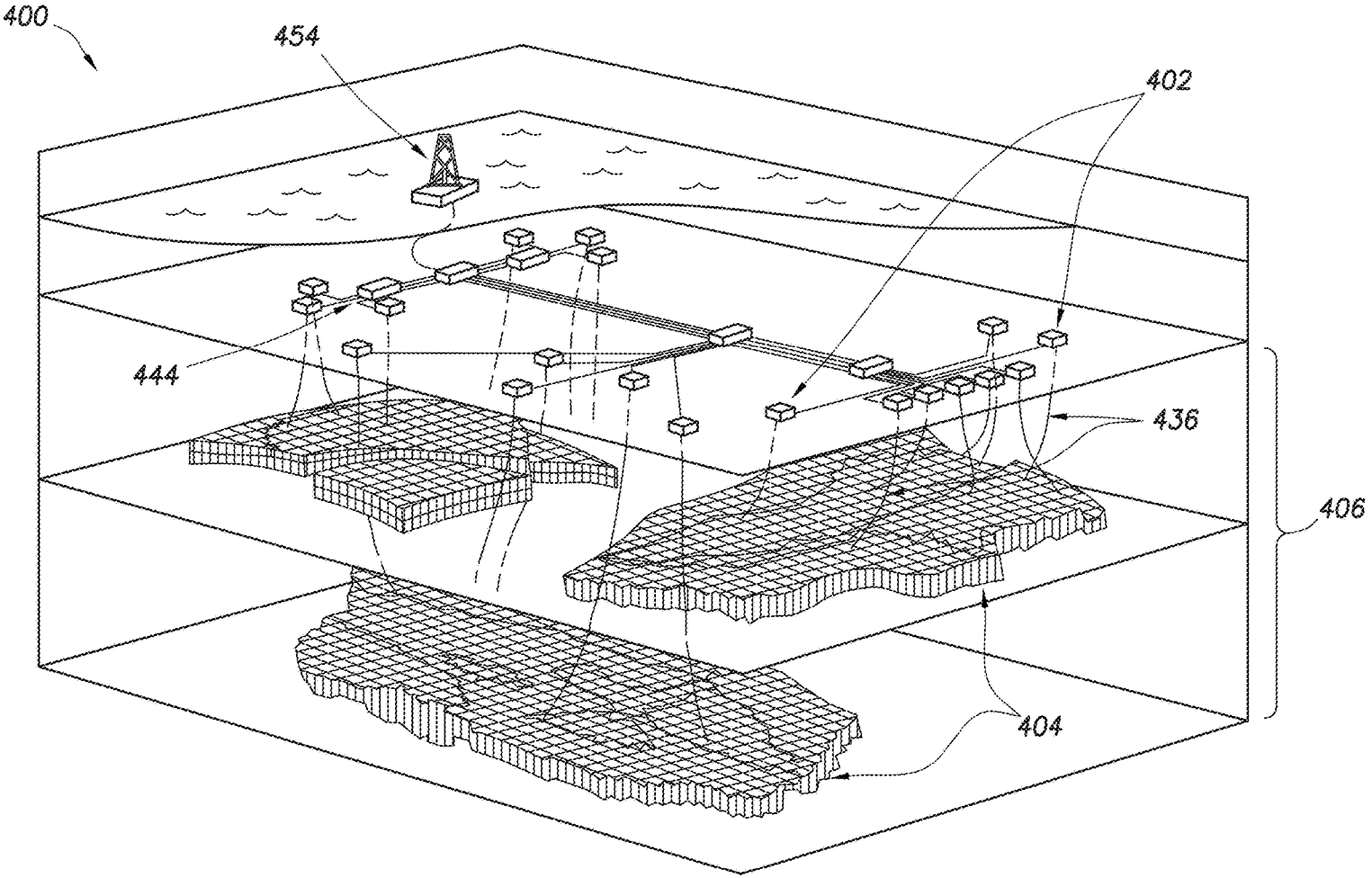

FIG. 4 shows a field (400) for performing production operations. As shown, the field has a plurality of wellsites (402) operatively connected to a central processing facility (454). The field configuration of FIG. 4 is not intended to limit improving production by actual loss allocation. Part or all of the field may be on land and/or sea. Also, while a single field with a single processing facility and a plurality of wellsites is depicted, any combination of one or more fields, one or more processing facilities and one or more wellsites may be present.

Each wellsite (402) has equipment that forms a wellbore (436) (i.e., borehole) into the earth. The wellbores extend through subterranean formations (406) including reservoirs (404). These reservoirs (404) contain fluids, such as hydrocarbons. The wellsites draw fluid from the reservoirs and pass them to the processing facilities via surface networks (444). The surface networks (444) have tubing and control mechanisms for controlling the flow of fluids from the wellsite to the processing facility (454).

Figure 5:
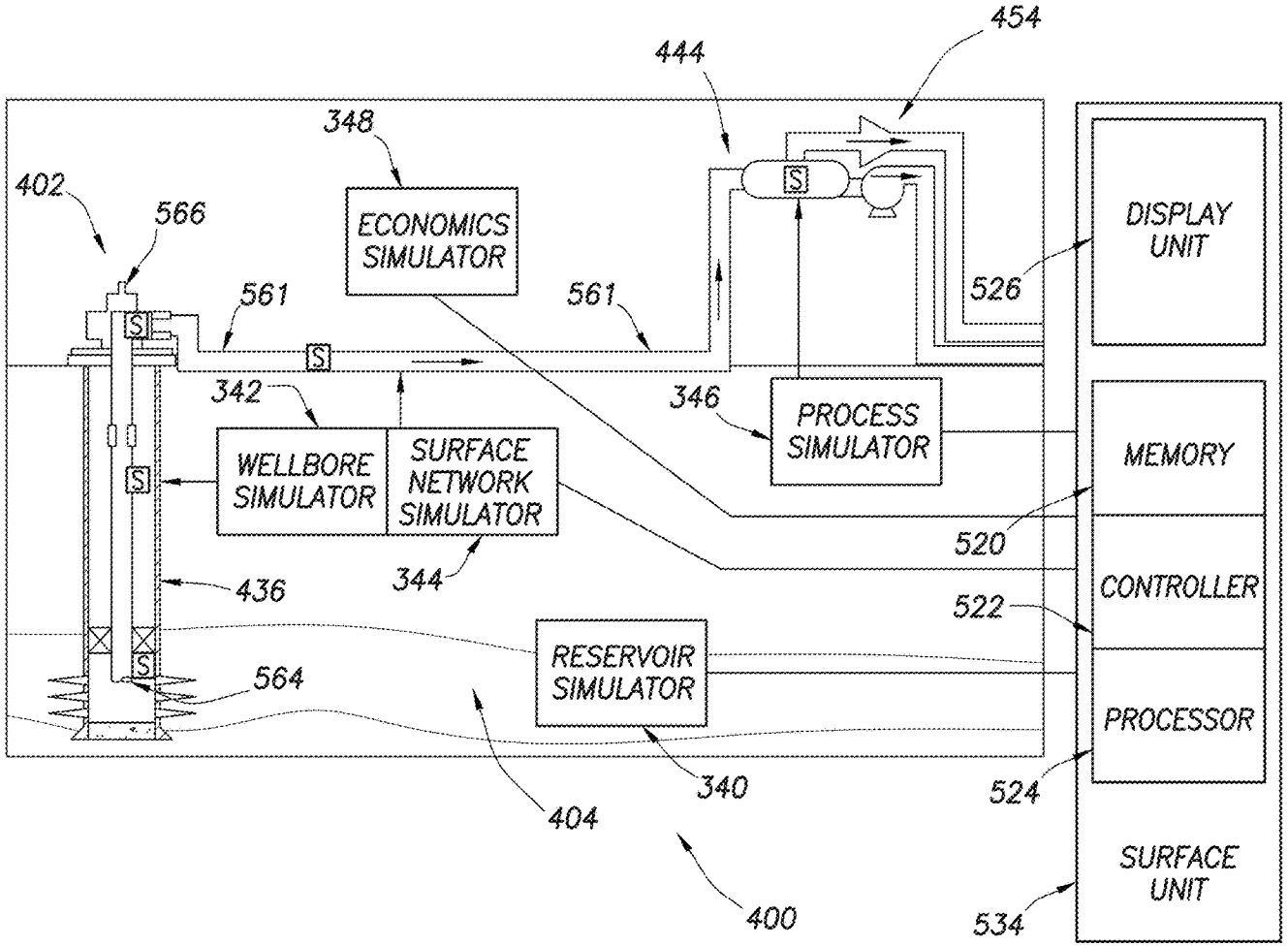

FIG. 5 shows a schematic view of a portion (or region) of the field (400) of FIG. 4, depicting a producing wellsite (402) and surface network (444) in detail. The wellsite (402) of FIG. 5 has a wellbore (436) extending into the earth therebelow. As shown, the wellbores (436) has already been drilled, completed, and prepared for production from reservoir (404).

Wellbore production equipment (564) extends from a wellhead (566) of wellsite (402) and to the reservoir (404) to draw fluid to the surface. The wellsite (402) is operatively connected to the surface network (444) via a transport line (561). Fluid flows from the reservoir (404), through the wellbore (436), and onto the surface network (444). The fluid then flows from the surface network (444) to the process facilities (454).

As further shown in FIG. 5, sensors (S) are located about the field (400) to monitor various parameters during operations. The sensors (S) may measure, for instance, resistivity, pressure, temperature, flow rate, composition, and other parameters of the reservoir, wellbore, surface network, process facilities and/or other portions (or regions) of the operation. These sensors (S) are operatively connected to a surface unit (534) for collecting data therefrom. The surface unit may be, for instance, similar to the surface unit (134) of FIG. 1.

One or more surface units (534) may be located at the field 400, or linked remotely thereto. The surface unit (534) may be a single unit, or a complex network of units used to perform the necessary data management functions throughout the field (400). The surface unit may be a manual or automatic system. The surface unit may be operated and/or adjusted by a user. The surface unit is adapted to receive and store data. The surface unit may also be equipped to communicate with various field equipment. The surface unit may then send command signals to the field in response to data received or modeling performed.

As shown in FIG. 5, the surface unit (534) has computer facilities, such as memory (520), controller (522), processor (524), and display unit (526), for managing the data. The surface unit (534) may be local or remote to the physical location of the wellsite. The data is collected in memory (520), and processed by the processor (524) for analysis. Data may be collected from the field sensors (S) and/or by other sources. For instance, production data may be supplemented by historical data collected from other operations, or user inputs.

The analyzed data (e.g., based on modeling performed) may then be used to make decisions. A transceiver (not shown) may be provided to allow communications between the surface unit (534) and the field (400). The controller (522) may be used to actuate mechanisms at the field (400) via the transceiver and based on these decisions. In this manner, the field (400) may be selectively adjusted based on the data collected. These adjustments may be made automatically based on computer protocol and/or manually by an operator. For example, based on revised log data, commands may be sent by the surface unit to the downhole tool to change the speed or trajectory of the borehole. In some cases, well plans are adjusted to select optimum operating conditions or to avoid problems.

To facilitate the processing and analysis of data, simulators may be used to process the data for modeling various aspects of the operation. Specific simulators are often used in connection with specific operations, such as reservoir or wellbore simulation. Data fed into the simulator(s) may be historical data, real time data or combinations thereof. Simulation through one or more of the simulators may be repeated or adjusted based on the data received.

As shown, the operation is provided with wellsite and non-wellsite simulators. The wellsite simulators may include a reservoir simulator (340), a wellbore simulator (342), and a surface network simulator (344). The reservoir simulator (340) solves for hydrocarbon flow through the reservoir rock and into the wellbores. The wellbore simulator (342) and surface network simulator (344) solves for hydrocarbon flow through the wellbore and the surface network (444) of pipelines. As shown, some of the simulators may be separate or combined, depending on the available systems.

The non-wellsite simulators may include process simulator (346) and economics (348) simulators. The processing unit has a process simulator (346). The process simulator (346) models the processing plant (e.g., the process facilities (454) where the hydrocarbon(s) is/are separated into its constituent components (e.g., methane, ethane, propane, etc.) and prepared for sales. The field (400) is provided with an economics simulator (348). The economics simulator (348) models the costs of part or the entire field (400) throughout a portion or the entire duration of the operation. Various combinations of these and other field simulators may be provided.

Figure 6:
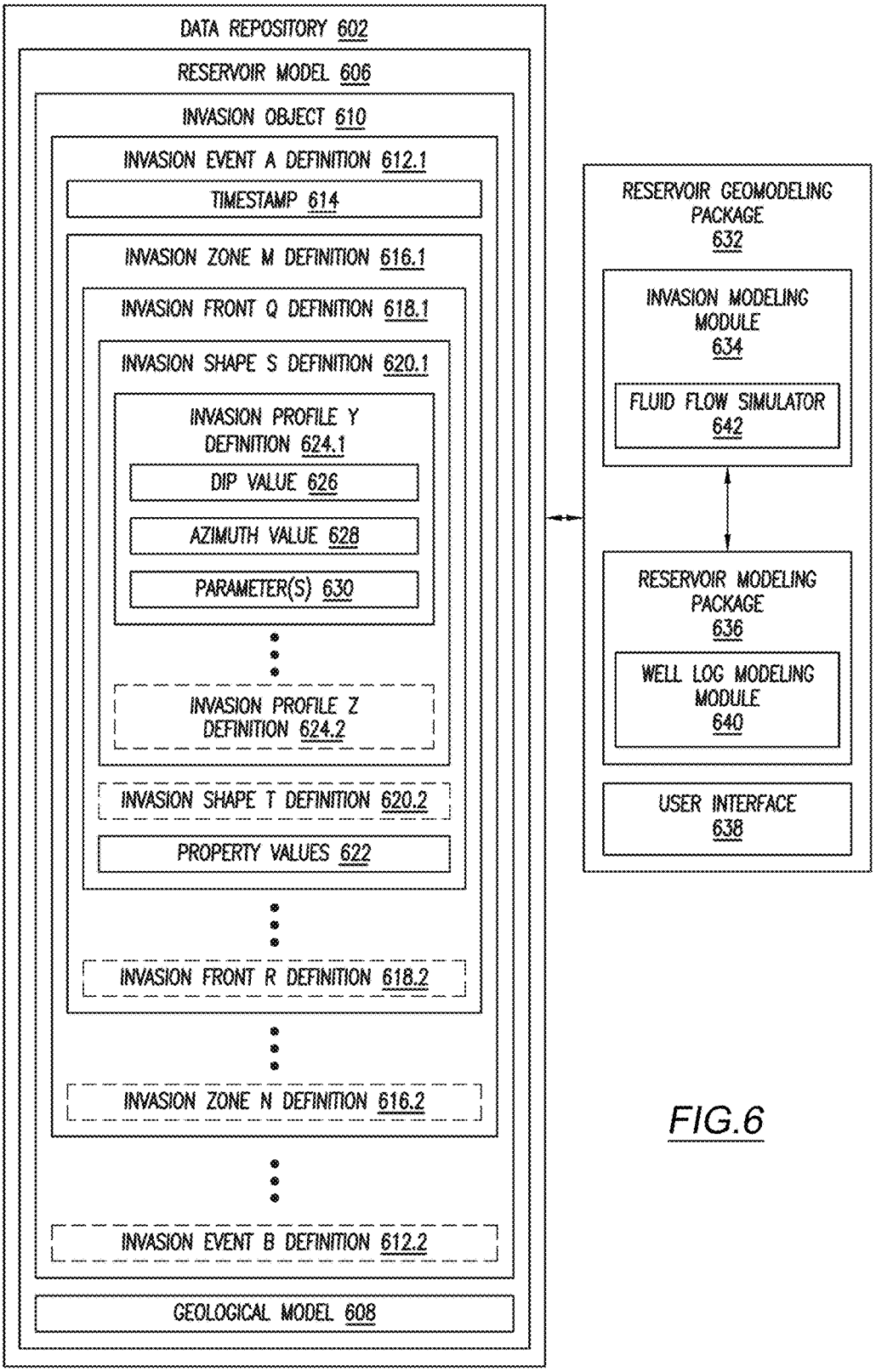

FIG. 6 shows a schematic diagram of a system for invasion modeling integrated in a reservoir model in one or more embodiments. In one or more embodiments, the system shown in FIG. 6 corresponds to at least a portion of the surface unit shown in FIGS. 1-5. In FIG. 6, three collinear dots indicate that more than one (e.g., two, three, four, etc.) of a same or similar component as the component before and after the collinear dots may optionally exist. Where more than one of the same component may exist, variables, such as 'A,' 'B,' 'X,' 'Y,' 'M,' 'N,' 'Q,' 'R,' 'S' and 'T,' are used to indicate that the two components that are liked named may have different data values. For example, invasion zone m definition (616.1) may be similar to invasion zone n definition (616.2) in that both invasion zone definitions each describe an invasion zone. However, the use of M and N indicates that the zones described, and, subsequently, the data in the corresponding invasion zone definitions are different. In the claims, the use of the cardinal numbers (e.g., first, second, third, fourth, etc.) perform the same functionality as the aforementioned variables to indicate that a particular component may be a different instance and have different values than a liked named component.

Further, the use of dashed lines around a component indicates that even in a single embodiment of the invention a particular component is optional. The use of the dashed lines does not expressly or implicitly indicate that components that do not have dashed lines are not optional in the same or different embodiments of the invention.

In one or more embodiments, in the description, the term, 'measured depth,' refers to a length of the borehole to a particular point, as if determined by a measuring stick. In one or more embodiments, measured depth differs from the true vertical depth of the well in all but vertical wells. In one or more embodiments, determining measured depth may be performed by aggregating the lengths of individual joints of drillpipe, drill collars and other drillstring elements when the drill bit is at the particular measured depth.

In one or more embodiments, the system includes a data repository (602) and reservoir geomodeling software (632). Both of these components are discussed below.

In one or more embodiments, the data repository (602) is any type of storage unit and/or device (e.g., a file system, database, collection of tables, or any other storage mechanism) for storing data. Further, the data repository (602) may include multiple different storage units and/or devices. The multiple different storage units and/or devices may or may not be of the same type or located at the same physical site. In one or more embodiments, the data repository includes functionality to store a geological model (606) (discussed below).

A reservoir model (608) is a representation of the physical space of the reservoir, where the physical space is partitioned into cells using a regular (i.e., structured) or irregular (i.e., unstructured) 3D grids. Physical properties (i.e., attributes) such as porosity, permeability and water saturation are assigned to individual cells. A geological model (606) is a reservoir model providing static description of the reservoir. The geological model (606) is a representation of the geology of the oilfield that is constructed from a variety of data gathered from the oilfield. Such data may include, but is not limited to, prior geological knowledge, seismic surveys, surface electromagnetic surveys, well logging and well monitoring, production history, core analysis, etc. The representation of the model may vary widely and may include structural and geological maps, cross-sections, description of the rocks and rock formations, borehole diagrams, etc. In its digital embodiment, the geological model includes a representation of geometry of the subsurface (in a form of a grid of cells) that describes the earth layers and faults, various surfaces describing fluid contacts (such as oil-water contact (OWC) and gas-oil contacts (GOC)). The model may include as data trajectories of the boreholes, various well markers, etc, as well as variety of physical properties inside the grid cells or on the surfaces. The physical properties may include porosity, permeability, resistivity, etc.

In one or more embodiments, an invasion object (610) corresponds to a description of an invasion in a borehole. Specifically, the invasion object (610) stores information describing a particular movement of fluid into the subsurface formation. In one or more embodiments, the invasion object (610) may store information about a current invasion in the borehole and/or a simulation of a possible invasion that may occur. A current invasion is one that has or is in the process of occurring. If the invasion object (610) provides information about a current invasion, the data for the invasion object may be generated automatically using oilfield data gathered directly from sensors at the oilfield. The following is a discussion of the primitives of the invasion object (610) from the fundamental element of the invasion object to the more complex primitive.

In one or more embodiments, an invasion object (610) includes at least one invasion profile definition (624.1, 624.2). An invasion profile definition (624.1, 624.2) provides a description of the invasion at a particular moment in time and at a particular measured depth. Specifically, the invasion profile definition (624.1, 624.2) describes the edge of the shape of the invasion at a constant time value for a constant measured depth value. In other words, the invasion profile definition describes a line denoting an edge of the shape of the invasion. In one or more embodiments, the shape of the invasion may be, for example, a teardrop shape, an arbitrary shape, a circle shape, or another defined shape.

In one or more embodiments, the edge of the shape of the invasion is defined as one or more parameters (630) in the invasion profile definition (624.1, 624.2). The parameter(s) (630) may include a shape identifier and edge parameters in one or more embodiments. The shape identifier uniquely identifies the shape of the invasion. For example, the shape identifier may define whether the shape is a teardrop shape, an arbitrary shape, a circle shape, or another defined shape. The edge parameters describe the size and major points of the shape.

For example, for a teardrop shape, the edge parameters may include three lengths. The first length represents a distance from a focus to each of two opposite points that are equidistant to the focus. The second length and third length represent two different distances from the same focus to two additional points that are opposite each other and a ninety-degree angle from the first length. In one or more embodiments, the focus is the trajectory of the borehole at a particular measured depth. Alternatively, the focus may be offset from the trajectory. When the focus is offset from the trajectory, the parameter(s) (630) may include an offset value.

As another example, for a circle shape, an edge parameter may be a radius of the circle. As another example, for an arbitrary shape, the edge parameters may represent any number of control points along the edge of the shape that describing a closed region. In one or more embodiments, for an arbitrary shape, each control point is defined using a theta and radius value. The radius is the distance from the borehole trajectory at the particular measure depth to the control point. The theta value defines an angle to the control point. In one or more embodiments, the edge of the shape is interpolated between the control points. For example, a Linear, Hermite, or any other method may be used to interpolate the edge of the shape from the control points.

In one or more embodiments, the invasion profile definition (624.1, 624.2) may additionally or alternatively include a dip value (626) and an azimuth value (628). The dip value and the azimuth value together describe the position of the edge of the shape in the three-dimension space of the formation relative to the trajectory of the borehole at the particular measured depth. In one or more embodiments, the dip value (626) defines the dip of the shape of the invasion at the particular measured depth. Specifically, the dip is an angle of descent relative to a horizontal plane. In one or more embodiments, the dip value is a value between zero and ninety degrees. In one or more embodiments, the azimuth value specifies the azimuth of the edge of the shape. The azimuth is an angle defining the direction of the dip as projected onto the horizontal plane. Although the above describes using a dip and azimuth to define a position of the profile in the three-dimensional space of the formation, other techniques may be used without departing from the scope of the claims.

Continuing with FIG. 6, one or more invasion profile definitions are combined into an invasion shape definition (620.1, 620.2). An invasion shape definition (620.1, 620.2) describes an invasion shape. An invasion shape is a surface along a continuous range of measured depths. The range of measure depths is defined along the trajectory of the borehole. In other words, an invasion shape is the surface defined by connecting a group of invasion profiles along the trajectory. Multiple invasion shapes may be defined for the same range of measured depths.

In one or more embodiments, an invasion front definition (616.1, 616.2) describes an invasion front. An invasion front is a closed volume along a range of measured depths. An invasion front may be defined as the closed volume between the trajectory of the borehole and an invasion shape. Alternatively, the invasion from may be defined as the closed volume between two invasion shapes. Thus, the invasion front definition (616.1, 616.2) may include one or two invasion shape definitions in one or more embodiments. If the invasion front definition (616.1, 616.2) includes a single invasion shape definition (620.1, 620.2), then the invasion front is the volume between the trajectory and the invasion shape along the range of measure depths defined by the invasion shape definition (620.1, 620.2). In one or more embodiments, if the invasion front definition includes two invasion shape definitions (620.1, 620.2), the two invasion shape definitions (620.1, 620.2) are defined for the same range of measured depths. Further, one invasion shape definition may be inside or closer to the borehole trajectory than another invasion shape. The inside invasion shape may be the same type or a different type than the outside invasion shape. For example, the inside invasion shape may be a teardrop shape while the outside invasion shape is an arbitrary shape.

In addition to invasion shape definition(s) (620.1, 620.2), an invasion front definition includes physical property values (622). The property values (622) describe the properties of the fluid in the invasion front. In one or more embodiments, the property values are constant throughout in the invasion front. In one or more embodiments, the property values may include related water saturation, salt concentration in the invasion front and other values defining the fluid of the invasion front including horizontal resistivity or conductivity, vertical resistivity or conductivity, density, etc.

In one or more embodiments, multiple invasion front definitions (618.1, 618.2) may be defined for the same range of measured depths. For example, one invasion front definition (618.1, 618.2) may describe an invasion front that is inside another invasion front. The inside invasion front may have different property values than the outside invasion front.

In one or more embodiments, the one or more invasion front definitions (618.1, 618.2) that are all defined for the same range of measured depths are grouped into an invasion zone definition (616.1, 616.2). An invasion zone definition (616.1, 616.2) represents the invasion along the particular range of measured depths.

In one or more embodiments, one or more invasion zones definitions (616.1, 616.2) may be combined into an invasion event definition (612.1, 612.2). An invasion event definition (612.1, 612.2) describes the invasion at a particular moment in time. Specifically, whereas an invasion is a movement of fluid into the formation surrounding the wellbore over time, an invasion event definition (612.1, 612.2) provides a snapshot of the invasion at the particular moment.

In one or more embodiments, the invasion event definition includes a timestamp (614) defining the particular moment. The timestamp (614) defines the time of the invasion event. The timestamp (614) may specify an actual time value or a relative time value. For example, the timestamp may be defined in terms of Greenwich Mean Time, Unix time, a number whereby each invasion event in the invasion object as a sequential number, or any other type of timestamp. Further, the timestamp may specify when the invasion event occurred or when the invasion event was recorded (e.g., by sensors, by the surface unit, etc.).

In one or more embodiments, multiple invasion events may be combined into an invasion object (610). The invasion object (610) describes the invasion over a period of time.

While FIG. 6 shows a configuration of the invasion object and the data repository, other configurations may be used without departing from the scope of the claims. For example, other schematics may be used to define an invasion object that is different from invasion profiles, shapes, events, and zones without departing from the scope of the claims. As another example, the data in a single component invasion object may be performed by two or more components and the data in two or more components described above and in FIG. 6 may be performed by a single component.

Continuing with FIG. 6, the reservoir geomodeling package (632) corresponds to the software and/or hardware of the surface unit. The reservoir geomodeling package (632) may include a reservoir modeling package (636), an invasion modeling model (634), and a user interface (638).

The reservoir modeling package (636) corresponds to hardware and/or software for modeling the properties of the oilfield. Specifically, the reservoir modeling module may include functionally to generate and update the reservoir model (608). For example, the reservoir modeling package may include one or more of the various simulators (e.g., economics simulator, process simulator, wellbore simulator, surface network simulator, reservoir simulator) discussed above and in FIG. 5. The reservoir modeling package may alternatively or additionally include a well log modeling module (640). The well log modeling module (640) includes functionality to obtain well logs describing properties gathered from a particular borehole, interpolate any missing data values, and present the properties to a user. The well log modeling module (640) may provide a simulation for an historical, current, or hypothetical borehole. Further, in one or more embodiments, the well log modeling model (640) includes functionality to update well log data based on an invasion. Specifically, data captured from the well logs may be distorted when an invasion occurs. Such distortion may be due to the differing properties of the invading mud as compared to the surrounding formation. The well log modeling module (640) includes functionality to correct the distorted data in the well logs based on the invasion so that the data is no longer distorted. In one or more embodiments, the reservoir model (608) may also be corrected, such as by the same or other components of the reservoir modeling package (636).

In one or more embodiments, the invasion modeling module (634) corresponds to hardware and/or software for modeling an invasion event. Specifically, the invasion modeling module (634) may be a plug-in to the reservoir modeling package (636), a part of the reservoir modeling package (636), or separate from the reservoir modeling package.

The invasion modeling module (634) includes functionality to obtain data from the oilfield and/or from a historical oilfield and generate an invasion event. The invasion modeling module (634) includes functionality to generate the invasion event automatically (e.g., directly from data gathered from the oilfield and the reservoir model (608)) and/or with input from a user. In one or more embodiments, the invasion modeling module (634) includes a fluid flow simulator (642). The fluid flow simulator (642) includes functionality to simulate the flow of fluid. Specifically, the fluid flow simulator (642) includes functionality to simulate how the mud flows or invades the formation surrounding the borehole.

Continuing with FIG. 6, the user interface (638) includes functionality to display and receive data from a user. For example, the user interface may include functionality to display the invasion event in three dimensions along the borehole trajectory. The user interface may include a field for the user to specify a file (e.g., ACII file, extensible markup language (XML) file, comma separated value (CSV) file, or another file) that includes an invasion object. The user interface may include a field for the user to specify the borehole trajectory, identify the particular wellsite, and/or specify where information may be obtained for the borehole and the invasion. The user interface (638) may further include functionality to allow a user to change the invasion object. For example, the user interface (638) may include functionality to display an invasion profile as defined by an invasion profile definition, receive a selection and movement of a control point or other parameter value. The user interface may further include functionality to update the reservoir modeling package, the invasion modeling module, and/or the data repository based on input from the user.

Additionally, in one or more embodiments, the user interface (638) includes functionality to display the invasion event within the geological context of the oilfield. Specifically, the user interface (638) includes functionality to present the invasion with the properties of the wellbore and the reservoir. The properties displayed may include, for example, resistivity, and other properties of the wellbore and surrounding formation. By combining the presentation of the invasion with the presentation of the reservoir model, a user may be able to have a more accurate depiction of the reservoir.

Although FIG. 6 shows a schematic diagram for an invasion object modeling, the schematic diagram in FIG. 6 may be applied to generally model a perturbation in the wellbore. In such a scenario, the invasion object (610), invasion event definition (612.1, 612.2), invasion zone definition (616.1, 616.2), invasion front definition (618.1, 618.2), invasion shape definition (620.1, 620.2), invasion profile definition (624.1, 624.2) may be a perturbation object, cylindrical event definition, cylindrical zone definition, cylindrical front definition, cylindrical shape definition, and cylindrical profile definition, respectively. Each of the cylindrical definitions may perform the function of the corresponding invasion definition shown in FIG. 6 and discussed above, but for any perturbation. Thus, the parameters (630) and property values (622) may be defined for the perturbation. Further, in such a scenario, the invasion modeling module (634) may be a cylindrical modeling module. The cylindrical modeling module includes functionality to model a perturbation along a wellbore trajectory. For example, the cylindrical modeling module may include functionality to model an invasion as an invasion modeling module or borehole shape change as a borehole modeling module.

By way of an example, consider the scenario in which the perturbation is a shape change of the borehole. In other words, the cylindrical model is to represent a portion of the borehole that may not be a cylindrical shape, but rather have one or more cross sections with irregular sides. In such a scenario, the perturbation object may be a borehole object with the properties and parameters describing the shape change of the borehole.

While FIG. 6 shows a configuration of components, other configurations may be used without departing from the scope. For example, various components may be combined to create a single component. As another example, the functionality performed by a single component may be performed by two or more components. Additionally, while the above discussed the components as being a part of the surface unit, some components may be a part of the downhole tool. Further, the surface unit may include multiple different physical devices, whereby each component of the surface unit is located on the same or different physical device as other components of the surface unit. The different physical devices may or may not be owned and/or operated by the same business entity or set of business entities.

Figure 7:
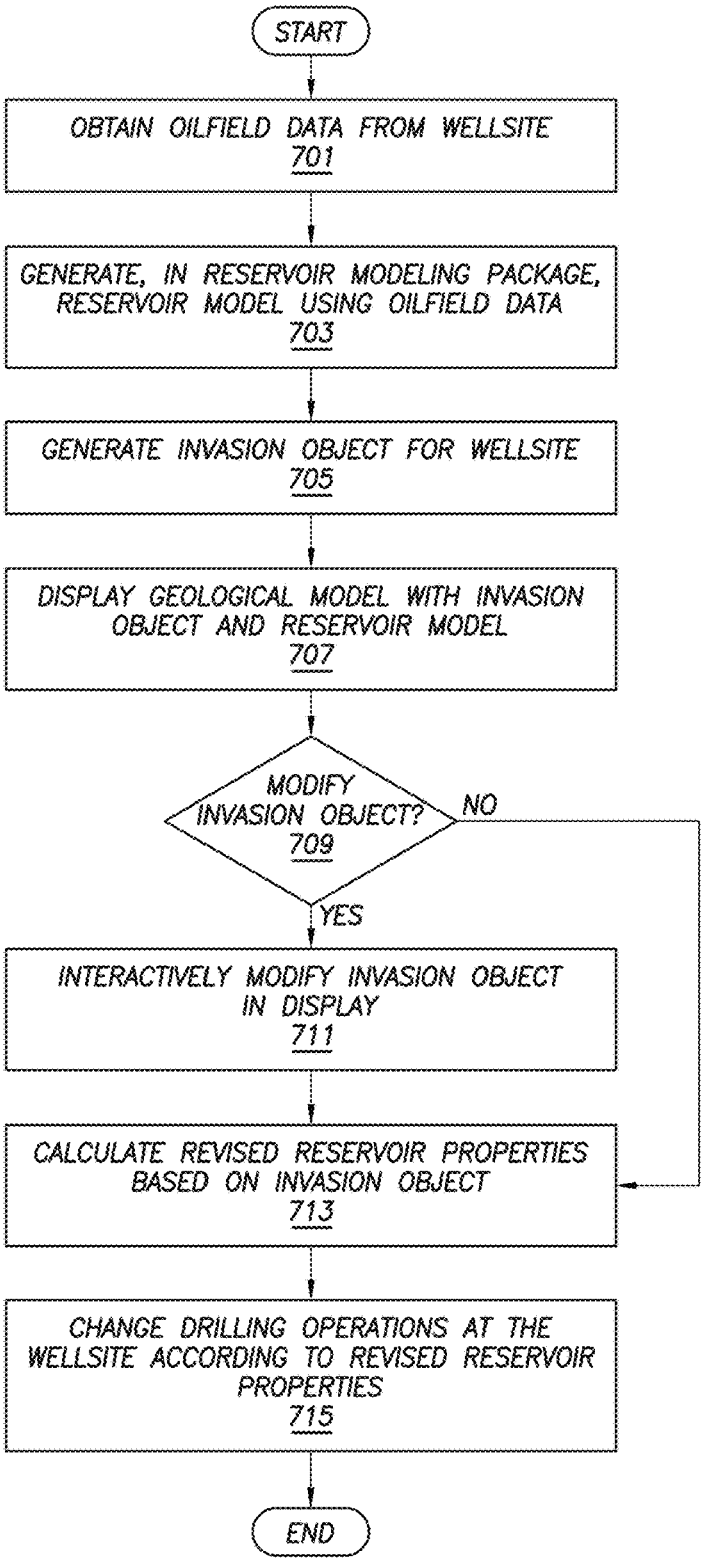
FIG. 7 shows an example flowchart of one or more embodiments.

FIG. 7 shows an example flowchart in one or more embodiments. While the various steps in this flowchart are presented and described sequentially, one of ordinary skill will appreciate that some or all of the steps may be executed in different orders, may be combined or omitted, and some or all of the steps may be executed in parallel. Furthermore, the steps may be performed actively or passively. For example, some steps may be performed using polling or be interrupt driven in accordance with one or more embodiments. By way of an example, determination steps may not require a processor to process an instruction unless an interrupt is received to signify that condition exists in accordance with one or more embodiments. As another example, determination steps may be performed by performing a test, such as checking a data value to test whether the value is consistent with the tested condition in accordance with one or more embodiments.

In 701, oilfield data is obtained from a wellsite in one or more embodiments. In particular, in one or more embodiments, data is gathered from various sensors and equipment distributed throughout the oilfield. Such data, sensors, and equipment may be gathered and include the data discussed above with reference to FIGS. 1-5. In addition to the data from the oilfield, historical data from other oilfields or wellsites may be used. Further, the obtained data may include data that is preprocessed (e.g., to check for accuracy and integrity, to change the units of measurement used, or to perform another type of preprocessing) or calculated from gathered sensor data. The oilfield data may include, for example, resistivity values, nuclear density, formation pressure, and sonic data.

In one or more embodiments, the oilfield data includes data obtained from the logging while drilling tool. The logging while drilling tool may gather measurements at different measured depths in the wellbore at a single moment in time. Further, the logging while drilling tool may gather measurements for the same measured depth at different times. For example, the logging while drilling tool may make multiple passes through the same point along the trajectory of the borehole. Such multiple passes may be, for example, the first time when the drilling bit reaches the depth, each time the drill string is pulled completely or partially out of the borehole, and during the tripping process. In one or more embodiments, measurements may also be taken over time while the logging while drilling is stationary. In such a scenario, the measurements may be with respect to time only. In one or more embodiments, the data is recorded and indexed by time and/or by depth. Using the recorded time indexed data, the invasion can be reconstructed.

In 703, in the reservoir modeling package, a reservoir model is generated in one or more embodiments. In one or more embodiments, generating the reservoir model is performed using techniques known in the art.

In 705, an invasion object is generated in one or more embodiments. The invasion object may be generated using the data from the logging while drilling or wireline or testing tool. Each moment in time may be stored as a different invasion event in the invasion object. For each invasion event, for example, an algorithm may be executed to infer the parameters of the formation including the geometry of each invaded zone, the resistivity of the invaded formation, and any offset from the center of the borehole. The algorithm may account for positions of formation boundaries, faults, and properties of formation layers near the particular range of measured depths for the invaded zone. Further, in one or more embodiments, the invasion object is generated with a different scale than the reservoir model. Specifically, the invasion object may be generated at a much smaller scale than the reservoir model, thereby providing more detail for the invasion object.

One method of generating an invasion object uses inversion. Inversion is a technique of generating a model based on acquired data. Specifically, a model is generated that fits the acquired data. The inversion-based workflow and algorithms are optimized based on measurement sensitivities. The workflow and algorithms are used to interpret the data and build reservoir models with characterization of the formation geometry and properties, invasion size, shape and properties. Inversion may use a Gauss-Newton algorithm to minimize a cost function. The cost function represents the error function and weighted sum of misfit between the measurements and the modeled tool responses, with appropriate regularization functions used to construct parametric interpretation model. In case of invaded formation, the model parameters may include the reservoir geometry (e.g., position of boundaries and faults), properties (e.g., water saturation, permeability or porosity or derived properties such as resistivity), and invasion geometry (e.g., tear-drop invasion, elliptical shape defined by semi-axes) and invasion properties such as resistivity. In addition, depending on measurements used, the borehole may be included in the model.

Besides the Gauss-Newton algorithm, alternative deterministic or probabilistic approaches are possible. Workflow may re-separate shallow information from deep information to ensure models are built that is consistent with all the data. The shallow measurements or information are more sensitive to formation near the wellbore are used to characterize the invasion. The deep measurements or information are used to characterize the "virgin" (i.e., uninvaded) formation and reservoir geometry, such as a distance to boundaries. A inversion workflow may include the following steps: (1) from deep sensing measurements, invert the distance to nearby boundaries and formation properties thereby building a one dimensional model; (2) using shallow measurements, invert the inversion profile and properties for given layered background model from step (1); and (3) compose a two dimensional and/or a three dimensional model from two previous steps and process the data with inversion to build the model. The model that is built in (3) may be built to include formation parameters (e.g., distance to boundaries, layer thicknesses and properties) and invasion parameters (e.g., invasion size, shape, and properties) and, if there is sensitivity in data, borehole model parameters (e.g., size of the borehole, eccentering and borehole mud properties). Additional workflows may be used that integrate multiple measurements with data acquired at different times. Such data that is acquired at different times includes data that follows the invasion. In these cases, the workflow and parameterizations may be common formation models and different invasion models. Details of algorithm used may depend on measurements used and the measurement's sensitivities.

Alternatively or additionally, a physics based simulation may be used to create the invasion object. In physics based simulation, an invasion object is created based, in part on data acquired from the formation using physics and other simulation knowledge. The physics based simulation may be used to forward model the invasion object. Specifically, generating the invasion object may include performing the following. Acquired data may be analyzed to create an initial invasion object. Log data is gathered from drilling the borehole. The log data may be gathered during or after drilling the borehole. Synthetic log data is generated from the initial invasion object using a physics based simulation. The log data is compared with the synthetic log data to identify any discrepancies. Based on any discrepancies a shape or a physical property or both of the initial perturbation object is modified to create a revised invasion object. The above steps may repeat one or more times until a discrepancy does not exist, is not discovered, or is within an allowed margin of error.

In one or more embodiments, rather than generating the invasion object as discussed above using the logging while drilling tool, a user may create an invasion object. For example, using the user interface of the reservoir geomodeling package, the user may specify the different definitions (discussed above and in FIG. 6) in the invasion object. As another example, the user may import a definition of the invasion object from a definition of a perturbation object from a file, an application, an algorithm integrated with the reservoir modeling package, or a combination thereof using the user interface.

In 707, a geological model having the invasion object and the reservoir model is displayed in one or more embodiments. For example, a visualization of the invasion may be generated and displayed along the trajectory of the wellbore. The visualization may be displayed with the reservoir model. Thus, in a single display, the user may view the invasion with one or more of a visualization of rock types, faults, permeability of the formation, resistivity, and other properties of the formation and borehole. The visualization may include a time lapse showing a change of the invasion over time (e.g., showing how over time the fluid of the invasion permeates into the formation surrounding the borehole). Although FIG. 7 shows and describes a single display of the geological model with the invasion, the user may interact and continually or periodically view the geological model.

In 709, a determination is made whether to modify the invasion object in one or more embodiments. In one or more embodiments, the user may decide to change the invasion object. For example, the user may determine that the simulated invasion does not accurately depict the actual invasion.

In such a scenario, in 711, the invasion object is modified. For example, the user may use the user interface to change the invasion object. For example, the user may change the parameters of the invasion profile, remove or add invasion zone, or perform other functions.

In one or more embodiments, 709 and 711 may be performed automatically. For example, after a first pass of the logging while drilling tool the drilling tool, an initial invasion object may be created that reflects an estimated invasion. Creating the initial invasion object may be based on data gathered during the first pass and/or data from similar boreholes. Additionally or alternatively, user input may be used to create the first invasion object. Using the fluid flow simulator, different invasion events for the invasion object may be created. Specifically, the different invasion events reflect an estimate of how the invasion of the fluid may flow into the formation over time.

During a subsequent pass of the logging while drilling tool, additional information may be collected. The additional information reflects how the invasion is actually occurring at a different moment in time. The actual invasion may be compared with the estimated invasion to determine if a discrepancy between the actual and the estimate exists. Specifically, estimate log data values for a well log may be generated based on the invasion events and compared with the actual log data values obtained from the logging while drilling tool. If the estimated invasion accurately capture the actual invasion, then no discrepancy may be deemed to have occurred. However, if a discrepancy exists, then the invasion object is modified based on the discrepancy to reflect the new logging while drilling data. Thus, the invasion object may be iteratively updated until the invasion object accurately reflects the invasion.

In one or more embodiments, inversion and/or physics based simulation may be used to modify the invasion object. Specifically, based on well log data or images, the invasion object geometry and physical properties may be updated using techniques, such as the inversion and/or simulation discussed above.

In 713, revised reservoir properties are calculated in one or more embodiments. In one or more embodiments, the invasion object and/or attributes of the invasion object obtained therefrom may be passed to the reservoir modeling package. The reservoir modeling package may be using the information about the invasion to provide more accurate reservoir data. For example, resistivity data may be adjusted to account for the existence of the invasion and correct well log data for the invasion effect using specialized processing based on modeling and/or inversion. For example, array resistivity measurement deliver multiple logs with different depth of investigation to provide sensitivity to invasion and information necessary to correct the invasion effect, or use the deepest log reading as the "true" resistivity of the "virgin" formation and fluids that are saturating it.

In 715, drilling operations at the wellsite are changed based on the revised reservoir properties in one or more embodiments. Specifically, once the properties of the formation and reservoir are corrected to account for the existence of the invasion, the corrected properties may result in change in how the drilling and/or production operations occur based on a new understanding of the formation. In such a scenario, control signals may be sent to the drilling or production tools to modify the equipment at the oilfield. For example, a signal may be sent to the bit to change the angle or speed of the rotation of the bit.

In one or more embodiments, 707-713 may correspond to integrating the invasion object with the reservoir model and forming the geological model. Further, although FIG. 7 describes integrating an invasion object in a reservoir model, the discussion and blocks of FIG. 7 may be used to generate a perturbation object and integrate the perturbation object with the reservoir model. Specifically, the technique described above may be used to create a more general perturbation object and integrate the more general perturbation object with the reservoir model. In such a scenario, the discussion above may be applied to the perturbation object for the perturbation.

FIGS. 8-13 show examples in one or more embodiments. The following examples are for explanatory purposes only and not intended to limit the scope of the claims.

Figure 8:
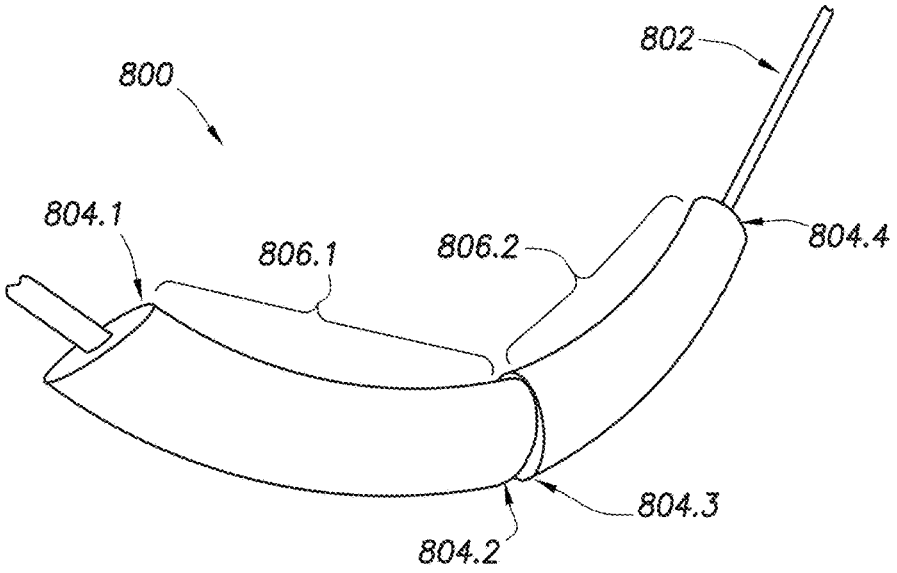

FIG. 8 shows an example diagram of an invasion (800) along a trajectory (802) of a borehole in one or more embodiments. The invasion (800) shown in FIG. 8 may be defined using invasion profile A (804.1), invasion profile B (804.2), invasion profile C (804.3), and invasion profile D (804.4). Each invasion profile is a loop that is a single line around the trajectory (802). The one or more invasion profiles may be combined to create invasion shape A (806.1) and invasion shape B (806.2). The invasion shape (e.g., invasion shape A (806.1), invasion shape B (806.2)) represents an outer shell of an invasion along a range of measure depths.

Figure 9:
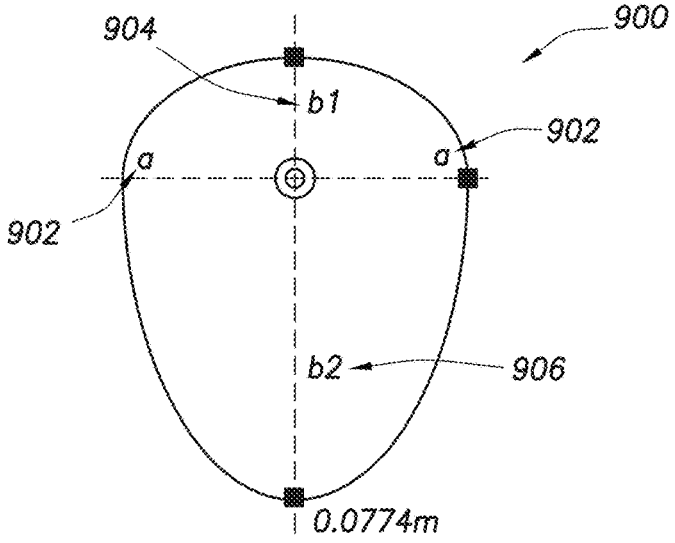

FIG. 9 shows an example diagram of a teardrop shape profile definition (900) in one or more embodiments. In the teardrop shape profile definition (900), the edges of the shape are defined by parameter A (902), parameter B1 (904), and parameter B2 (906). As shown parameter A (902) reflects a length from a focus to the two opposite edge points of the shape that is equidistant. Parameter B1 (904) and parameter B2 (906) reflect the length from the focus to the two opposite edge points that are not equidistant, and is perpendicular to the length denoted by parameter A (902).

FIG. 10 shows an example of an arbitrary shape profile definition (1000). As shown in FIG. 10, the arbitrary shape profile definition (1000) includes parameters defining control points (e.g., control point A (1002.1), control point B (1002.2), control point C (1002.3)) on the edge that specify the shape in one or more embodiments. The points on the edge that are not specified may be interpolated in one or more embodiments. For example, line segment BC (1004) may be interpolated based on control point B (1002.2) and control point C (1002.3).

FIG. 11 shows an example of an invasion (1100) along a trajectory (1102) of a borehole in one or more embodiments. As shown in FIG. 11, the invasion may be described using invasion shape A (1104.1), invasion shape B (1104.2), invasion shape C (1104.3). Each invasion shape describes a surface in one or more embodiments. As shown in the example FIG. 11, even though the invasion shapes are along the same range of measured depths (e.g., along the same range of the trajectory (1102), the invasion shapes may be the combination of different invasion profiles. For example, whereas invasion shape A (1104.1) is composed of arbitrary shape invasion profiles, invasion shape B (1104.2) is composed of teardrop shape invasion profiles. The volume between two neighboring overlapping invasion shapes is an invasion front. FIG. 11 shows three example invasion fronts (e.g., invasion front A (1106.1), invasion front B (1106.2), and invasion front C (1106.3)). As shown the invasion front is the volume between two invasion neighboring invasion shapes that are defined for the same range of measured depths in one or more embodiments. The properties of a particular invasion front are constant throughout the invasion front. However, different invasion fronts may have different properties. For example, the resistivity of invasion front B (1106.2) may be different from the resistivity of invasion front C (1106.3).

FIG. 12 shows an example invasion (1200) along trajectory (1202) of the borehole that has four invasion zones (e.g., invasion zone A (1204.1), invasion zone B (1204.2), invasion zone C (1204.3), and invasion zone D (1204.4)). Each invasion zone describes a portion of the invasion along different ranges of measure depths along the trajectory (1202). Further, as shown in the example FIG. 12, the invasion zone D (1204.4) may include two invasion fronts (e.g., invasion front A (1206.1), invasion front B (1206.2)). Further, as shown in the example FIG. 12, the outer invasion shape of invasion front (1206.2) is composed of invasion profiles that define an ever increasing size of the shape. In other words, the invasion profiles on the same example invasion shape are not equidistant to the trajectory (1202).

Figure 13:
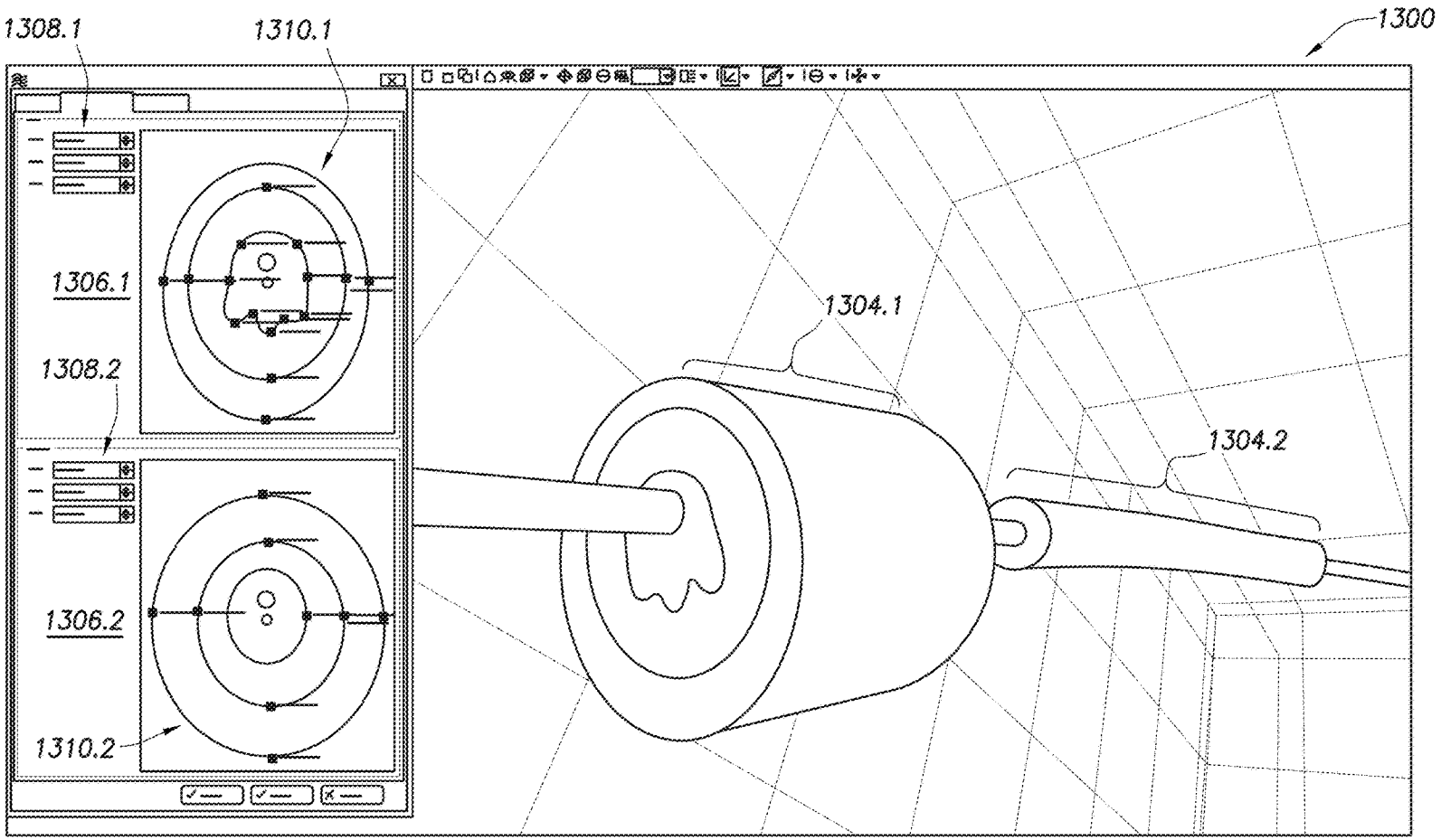

FIG. 13 shows an example user interface (1300) for a user to view and modify an invasion in one or more embodiments. In the example user interface an invasion (1302) is displayed showing two invasion zones (e.g., invasion zone A (1304.1), invasion zone B (1304.2)). Each invasion zone has a corresponding pane in the user interface (1300). For example, invasion zone A (1304.1) corresponds to pane A (1306.1) and invasion zone B (1304.2) corresponds to invasion pane B (1306.2). The pane (e.g., pane A (1306.1), pane B (1306.2)) includes fields (e.g., fields A (1308.1), fields B (1308.2)) and a diagram (e.g., diagram A (1310.1), diagram B (1310.2)) of the invasion profiles having parameters for the invasion zone. Using the user interface (1300), a user may manually change the values of the parameters and properties in the fields (e.g., fields A (1308.1), fields B (1308.2)). Alternatively or additionally, a user may select and drag different points on the invasion profiles in the diagram (e.g., diagram A (1310.1), diagram B (1310.2)) to change parameters of the invasion profiles. Thus, the user interface (1300) allows a user to view and modify an invasion object.

Figure 14:
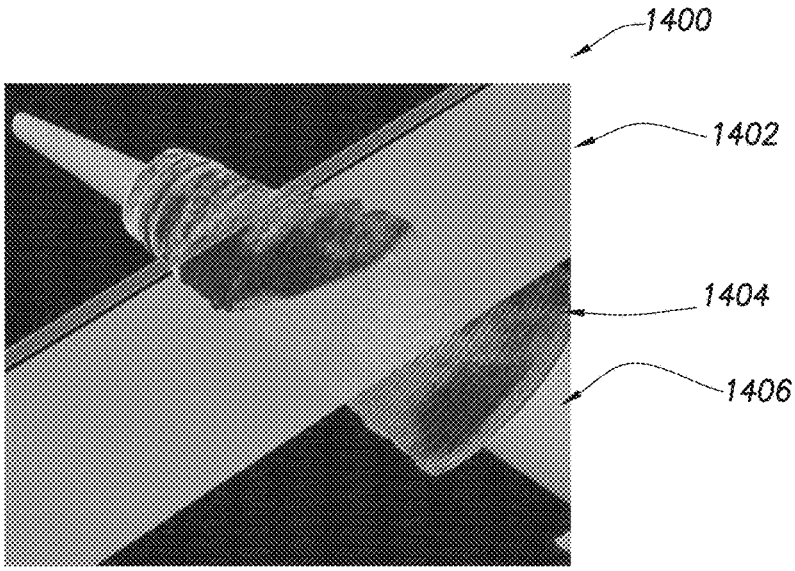
Figure 15:
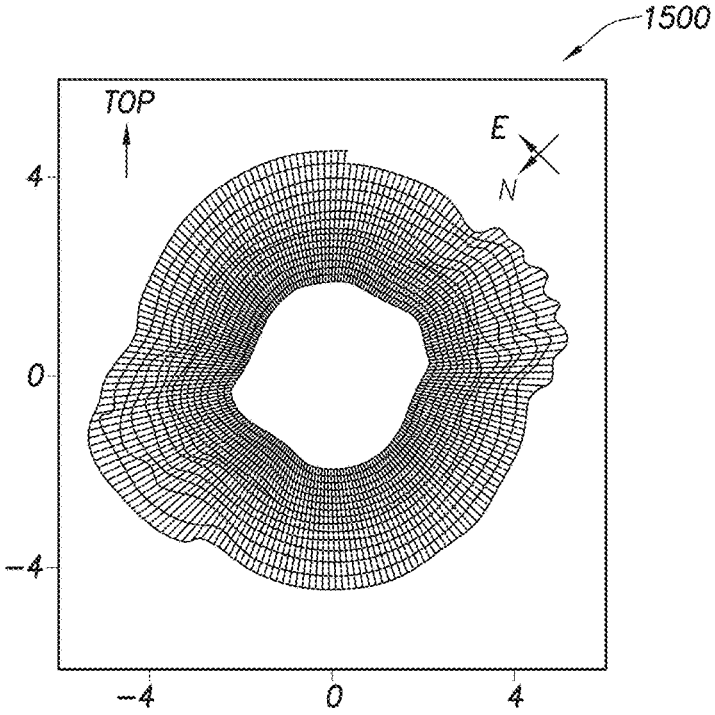

FIG. 14 shows a wellbore trajectory (1406) with shape change of the borehole. Specifically, FIG. 14 shows a display (1400) of a borehole object (1404) integrated in a reservoir model. A cross-section (1402) of the shape change of the borehole is shown in FIG. 15. As shown in FIG. 15, rather than being a circle or ellipse, the cross section (1500) is an irregular shape. In one or more embodiments of the invention, the borehole object is able to model the irregular shape of the borehole. Further, because embodiments integrate the borehole object with the reservoir model, the geometry and properties of the reservoir model may be updated based on interpretation and knowledge obtained from the borehole object.

Figure 16:
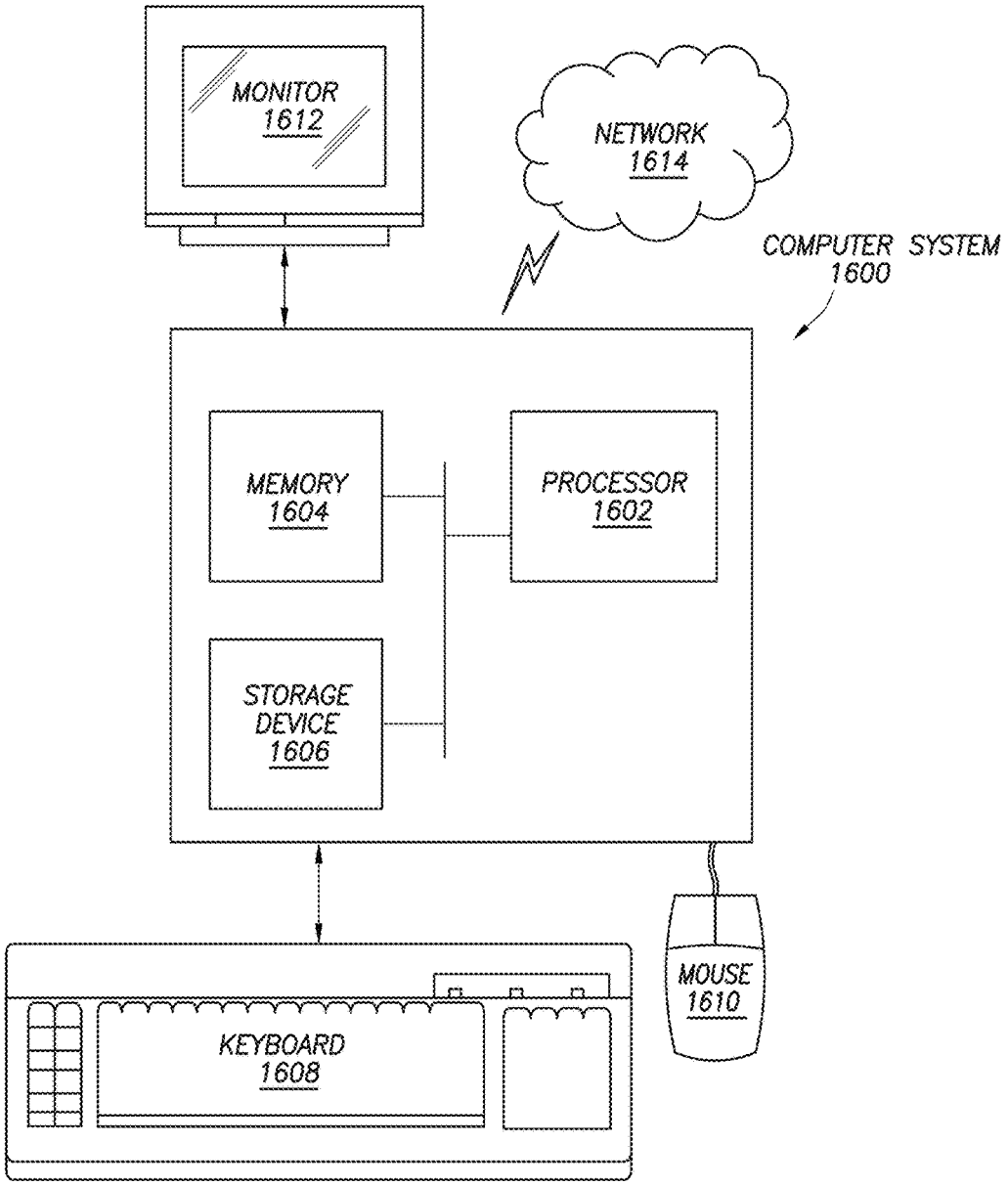
FIG. 16 shows an example computer system for the implementation of one or more embodiments.

Embodiments may be implemented on virtually any type of computer regardless of the platform being used. For example, as shown in FIG. 16, a computer system (1600) includes one or more hardware processor(s) (1602), associated memory (1604) (e.g., random access memory (RAM), cache memory, flash memory, etc.), a storage device (1606) (e.g., a hard disk, an optical drive such as a compact disk drive or digital video disk (DVD) drive, a flash memory stick, etc.), and numerous other elements and functionalities typical of today's computers (not shown). In one or more embodiments, the processor (1602) is hardware. For example, the processor may be an integrated circuit. The computer system (1600) may also include input means, such as a keyboard (1608), a mouse (1610), or a microphone (not shown). Further, the computer system (1600) may include output means, such as a monitor (1612) (e.g., a liquid crystal display (LCD), a plasma display, or cathode ray tube (CRT) monitor). The computer system (1600) may be connected to a network (1614) (e.g., a local area network (LAN), a wide area network (WAN) such as the Internet, or any other type of network) via a network interface connection (not shown). Many different types of computer systems exist, and the aforementioned input and output means may take other forms. Generally speaking, the computer system (1600) includes at least the minimal processing, input, and/or output means necessary to practice embodiments.

Software instructions in the form of computer readable program code to perform embodiments may be stored, in whole or in part, temporarily or permanently, on a computer readable medium such as a compact disc (CD), a diskette, a tape, physical memory, or any other computer readable storage medium. Specifically, the software instructions may correspond to computer readable program code that, when executed by a processor(s), is configured to perform embodiments. In one or more embodiments, the computer readable medium is a non-transitory computer readable medium.

Further, one or more elements of the aforementioned computer system (1600) may be located at a remote location and connected to the other elements over a network. Further, embodiments may be implemented on a distributed system having a plurality of nodes, where each portion may be located on a different node within the distributed system. In one or more embodiments, the node corresponds to a computer system. Alternatively, the node may correspond to a processor with associated physical memory. The node may alternatively correspond to a processor or micro-core of a processor with shared memory and/or resources.

Although only a few example embodiments have been described in detail above, those skilled in the art will readily appreciate that many modifications are possible in the example embodiments without materially departing from integrating invasion modeling with reservoir modeling. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for characterizing a subterranean formation traversed by a borehole and changing drilling operations based upon an updated reservoir model, the method comprising:

providing or generating a reservoir model that represents the subterranean formation, wherein the reservoir model includes i) data representing geometry of the subterranean formation including at least one of a formation boundary, fault, or fluid contact, and ii) data representing properties of the subterranean formation;

generating an invasion object that stores information describing invasion of fluid surrounding the borehole drilled in a horizontal well, wherein the reservoir model uses a first scale and the invasion object uses a second scale that is larger than the first scale thereby providing more detail for the invasion object, wherein the invasion object comprises at least one invasion profile definition including an inside invasion shape and an outside invasion shape;

displaying, at a graphical user interface, at least a portion of the reservoir model at the first scale and the invasion object at the second scale that is larger than the first scale;

modifying, at the graphical user interface, the invasion object while displaying the reservoir model and the invasion object;

using a modified invasion object to update the reservoir model and generate an updated reservoir model; and using, at least in part, the updated reservoir model to change drilling operations at the borehole.

2. The method of claim 1, further comprising displaying a time lapse change in the shape of the invasion.

3. The method of claim 1, wherein the invasion object comprises an invasion object shape identifier and at least one parameter defined for an invasion object shape.

4. The method of claim 1, wherein:

the interface is configured to allow a user to import a definition of the invasion object from a file, an application, an algorithm, or a combination thereof.

5. The method of claim 1, wherein generating the invasion object comprises:

generating an initial invasion object that reflects an estimated invasion of fluid surrounding the borehole;

gathering measured log data while drilling the borehole, after drilling the borehole, or both;

generating synthetic log data from the initial invasion object using a physics based simulation, wherein the physics-based simulation is based in part on data acquired from the formation using physics and other simulation knowledge;

comparing the measured log data with the synthetic log data to identify a discrepancy; and updating the initial invasion object to define a revised invasion object based on the discrepancy such that the revised invasion object more accurately reflects the invasion of fluid surrounding the borehole.

6. A system for characterizing a subterranean formation traversed by a borehole and changing drilling operations based upon an updated reservoir model, the system comprising:

a computer processor; and a computer readable storage medium comprising instructions, which when executed on the computer processor, are configured to:

provide or generate a reservoir model that represents the subterranean formation, wherein the reservoir model includes i) data representing geometry of the subterranean formation including at least one of a formation boundary, fault, or fluid contact and ii) data representing properties of the subterranean formation;

generate an invasion object that stores information describing invasion of fluid surrounding the borehole drilled in a horizontal well, wherein the reservoir model uses a first scale and the invasion object uses a second scale that is larger than the first scale thereby providing more detail for the invasion object, wherein the invasion object comprises at least one invasion profile definition including an inside invasion shape and an outside invasion shape;

display, at a graphical user interface, at least a portion of the reservoir model at the first scale and the invasion object at the second scale that is larger than the first scale;

modify, at the graphical user interface, the invasion object while displaying the reservoir model and the invasion object;

use a modified invasion object to update the reservoir model and generate an updated reservoir model; and at least one drilling tool configured to use, at least in part, the updated reservoir model to change drilling operations at the borehole.

7. The system of claim 6, wherein the computer readable storage medium further comprises instructions, which when executed on the computer processor, are configured to:

simulate a well log based on the invasion object.

8. The system of claim 6, wherein the computer readable storage medium further comprises instructions, which when executed on the computer processor, are configured to:

perform an inversion that compares gathered log data with a physics based simulation response to create a revised invasion object.

9. The system of claim 8, wherein the gathered log data is gathered at different times.

10. The system of claim 6, wherein the invasion object comprises a plurality of invasion events, and wherein each invasion event of the plurality of invasion events describes the invasion at a particular moment in time corresponding to the invasion event.

11. The system of claim 6, wherein the invasion object further comprises:

a first invasion shape definition describing a surface of the invasion object, wherein the invasion shape definition is a concatenation of a plurality of invasion profile definitions.

12. The system of claim 11, wherein the invasion object further comprises:

an invasion front definition comprising the first invasion shape definition and a second invasion shape definition, wherein the invasion front defines a volume between a first invasion shape defined by the first invasion shape definition and a second invasion shape defined by the second invasion shape definition.

13. The system of claim 12, wherein the computer readable storage medium further comprises instructions, which when executed on the computer processor, are configured to:

perform an inversion that constructs the invasion front.

14. The system of claim 6, wherein the invasion object comprises an invasion zone definition that describes an invasion volume of the invasion between two measured depths of a trajectory.

15. The system of claim 11, wherein the interface is configured to:

receive a selection and movement of a point, defined for the invasion object, on a display of the reservoir model via user input; and initiate a modification of the invasion object based on the selection and movement of the point via user input.

16. The method of claim 1, further comprising:

while displaying the invasion object and the reservoir model, performing modeling operations on the subterranean formation using data associated with the invasion object and data associated with the reservoir model.

17. The method of claim 1, wherein:

the representation of geometry of the subterranean formation of the reservoir model comprises at least one of a position of a subterranean formation boundary and a position of a subterranean formation fault.

18. The method of claim 1, wherein:

the properties of the reservoir model comprise at least one of porosity, permeability, resistivity, and water saturation.

19. The method of claim 1, wherein:

the updating of the reservoir model involves calculating revised reservoir properties based on the invasion object.

20. The method of claim 19, wherein:

the revised reservoir properties comprise resistivity data that accounts for the existence of the invasion as represented by the invasion object and that infers true resistivity of the subterranean formation.

21. The method of claim 19, further comprising:

modifying drilling operations based on revised reservoir properties.

22. The method of claim 1, wherein:

the information of the invasion object describes an invasion shape.

23. The method of claim 1, wherein:

the information of the invasion object describes at least one physical property of fluid in the invasion.

24. The method of claim 23, wherein:

the at least one physical property of fluid in the invasion comprises at least one of water saturation, salt concentration, resistivity, conductivity, and density.

25. The method of claim 1, wherein:

the information of the invasion object describes the invasion at a particular measured depth of the borehole.

26. The method of claim 25, wherein:

the information of the invasion object includes a dip value and an azimuth value that together describe position of an edge of the invasion in three-dimensional space of the subterranean formation relative to trajectory of the borehole at the particular measured depth of the borehole.

27. The method of claim 1, wherein:

the information of the invasion object describes the invasion along a particular range of measured depths of the borehole.

28. The method of claim 1, wherein:

the information of the invasion object describes the invasion at a particular moment in time.

29. The method of claim 1, wherein:

the information of the invasion object describes multiple invasion events that occur over a period of time.

30. The method of claim 1, wherein:

the invasion object is stored as part of the reservoir model.

31. The method of claim 1, wherein:

the interface is configured to allow a user to specify a file that includes the invasion object.

32. The method of claim 1, wherein:

the interface is configured to display the invasion in three dimensions along a trajectory of the borehole.

33. The method of claim 1, wherein:

the interface is configured to allow a user to change the invasion object.

34. The method of claim 33, wherein:

the change to the invasion object includes i) a change to at least one parameter of an invasion profile; or ii) removal or addition of an invasion zone.

35. The method of claim 1, wherein:

the interface is configured to allow a user to specify at least one parameter or property of an invasion zone of the invasion object.

36. The method of claim 1, wherein:

the interface is configured to allow the user to select and drag at least one point on an invasion profile in order to change one or more parameters of the invasion profile.

* * * * *